United States Patent [19]

Shinoda

[11] 4,171,497

[45] Oct. 16, 1979

[54] SEALED BEAM LAMP FOR AUTOMOBILE

[75] Inventor: Arihiro Shinoda, Hatano, Japan

[73] Assignee: Stanley Electric Co., Ltd., Tokyo, Japan

[21] Appl. No.: 923,496

[22] Filed: Jul. 11, 1978

[30] Foreign Application Priority Data

Jul. 18, 1977 [JP] Japan ..... 52-94441[U]

[51] Int. Cl.[2] ..... H01K 1/46; H01R 33/06

[52] U.S. Cl. ..... 313/113; 313/318; 339/145 R

[58] Field of Search ..... 313/113, 115, 318; 339/145 R, 144 R, 144 T

[56] References Cited

U.S. PATENT DOCUMENTS

| | | | |
|---|---|---|---|
| 3,286,088 | 11/1966 | Ahroni | 339/144 R |
| 3,417,367 | 12/1968 | Dayton et al. | 339/145 R |
| 3,559,153 | 1/1971 | Cartelli | 339/145 R |
| 3,800,377 | 4/1974 | Palmen | 313/318 X |
| 3,997,808 | 12/1976 | Wojtowicz | 313/113 |

*Primary Examiner*—Palmer C. Demeo

*Attorney, Agent, or Firm*—Flynn & Frishauf

[57] ABSTRACT

A sealed beam lamp for an automobile comprises a halogen bulb mounted on a reflector. A bracket is mounted on the reflector and has a socket recess in which a pinch sealed portion of the halogen bulb is inserted and held, for example with an adhesive agent.

5 Claims, 2 Drawing Figures

SEALED BEAM LAMP FOR AUTOMOBILE

BACKGROUND OF THE INVENTION

The present invention relates to a sealed lamp for an automobile, and more particularly to a sealed lamp having a halogen bulb adapted for use as a head lamp or a fog lamp for an automobile.

In conventional sealed beam lamps having a halogen bulb, the bulb is mounted on supports extending from a reflector by directly fixing terminals of the halogen bulb, that is, contacts protruding from a pinch sealed portion of the halogen bulb, by means of spot welding. The halogen bulb having such a mounting structure causes dispersion in the mounting position of the halogen bulb and has a possibility that a filament portion of the halogen bulb is not disposed at a proper focus position relative to the reflector. Further, in the sealed beam lamp manufactured as mentioned above, since setting of the focus is realized only by mechanical means, its optical accuracy decreases.

It is an object of the invention to provide a sealed lamp having a halogen bulb in which a mounting structure enables a stable irradiating characteristic to the achieved.

SUMMARY OF THE INVENTION

According to one aspect of the invention, a sealed lamp has a mounting structure for a halogen bulb comprising supports mounted on a reflector, a bracket mounted on the supports and having a socket recess, terminals disposed in the recess and electrically connected to the supports, and a pinch-sealed portion of the halogen bulb having contacts abutting with the terminals and inserted and held in the recess for example with an adhesive agent. Accordingly, the bracket is uniformly set so that the filament (light source) is brought into a desired focus position when the halogen bulb is inserted into the recess. The dispersion of the halogen bulb itself is adjusted between it and the bracket when inserted into the recess. Further, the halogen bulb is adhered and fixed at the optically determined position of focus in the recess and therefore the sealed lamp having such a halogen bulb mounting can be obtained without introducing dispersion in the mounting position.

DETAILED DESCRIPTION OF PREFERRED EMBODIMENT

Figure 1:
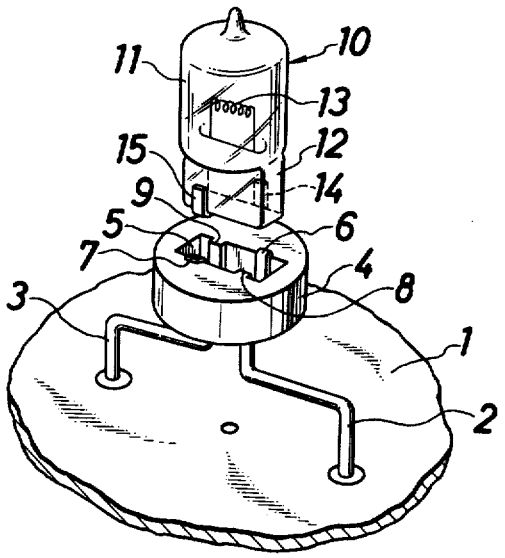
FIG. 1 is a perspective view showing essential parts of a mounting structure for a halogen bulb in a sealed lamp according to the invention.
Figure 2:
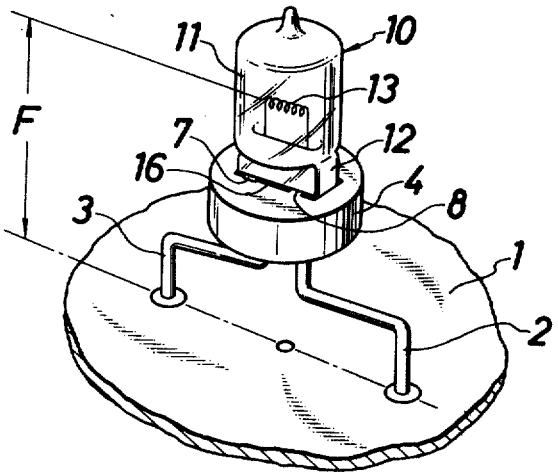
FIG. 2 is a perspective view showing a bulb mounted in the mounting structure shown in FIG. 1.

Referring to FIGS. 1 and 2, there is shown a mounting structure for a halogen bulb disposed on a reflector 1. On the reflector 1 are mounted electrically conducting supports 2 and 3 in a standing condition. A bracket 4 of heat-resisting insulation material, such as ceramic or the like, is mounted on ends of the supports 2 and 3. The bracket 4 has a socket recess 5 formed in an upper surface thereof. Terminals 6 and 7 electrically connected with respective ones of the supports 2 and 3 are arranged along opposed walls of the recess 5. Protruded from the opposed walls of recess 5 are protrusions 8 and 9 formed integrally with the walls and opposing respective terminals 6 and 7. The other ends of the supports 2 and 3 are connected to ferrule bosses at outside of the reflector 1, as in the conventional sealed lamp (it is not shown in Figures) and outer terminals are mounted on the ferrule bosses.

A halogen bulb 10 inserted into and mounted on the above mentioned bracket 4 includes a burner portion 11 and a pinch-sealed portion 12. A filament 13 is disposed inside of the burner portion 11 and contacts 14 and 15, connected to the filament, are extended out from lower ends of the pinch-sealed portion 12. The contacts 14 and 15 are bent in opposed directions to each other and are positioned along side surfaces of the pinch-sealed portion 12. Such contacts bent in the directions opposite to each other are required to be in the direction and position in which they contact with the terminals 6 and 7, respectively.

When combining the halogen bulb 10 with the bracket 4 constituted as mentioned above, the pinch-sealed portion 12 of the halogen bulb is inserted into the socket recess 5 and the contacts 14 and 15 are press-contacted with the terminals 6 and 7. Further, after adjusting the filament 13 of the halogen bulb so that it is brought into the focal length F of the reflector, adhesive 16 is applied in a clearance between the pinch-sealed portion 12 and the socket recess 5 formed by the terminals 6 and 7 and the protrusions 8 and 9 so as to fix them in relative position. Since the above mentioned adjustment is realized according to the filament condition of the halogen bulb, for example, by adjusting the inserting length of the pinch-sealed portion into the recess, or adjusting the inclination of the pinch-sealed portion or the like, and the filament is positioned to be brought into proper focal length F, the adjustment can be realized in an optically fine manner without mechanical difficulties. Since the bracket 4 and the halogen bulb 10 are finally fixed together by the adhesive 16, their combination is stable.

As understood from the above description, the mounting structure of the halogen bulb in the sealed beam lamp according to the invention comprises a mounting bracket having a socket recess and the pinch-sealed portion of the halogen bulb inserted into the socket recess and fixed in the socket recess, for example by an adhesive. In this structure, since the filament is exactly positioned at the proper focal length or distance by adjusting the inserting length or by adjusting the inclined condition of the bulb relative to the socket, a stable sealed beam lamp can be obtained without dispersion in the irradiating characteristic.

Although the above description has been made with reference to a sealed beam lamp, the present invention is not limited only to sealed beam lamps but also can be used for a fog lamp. In this case, it is sufficient to have only one filament, as shown in FIGS. 1 and 2.

What is claimed is:

1. A sealed beam lamp comprising:

a sealed halogen bulb (10) having a pinch-sealed portion (12), a filament (13) therein and at least two lead-out contact members (14,15) coupled to said filament and extending out of said pinch-sealed portion (12);

a reflector (1);

electrically conducting supports (2,3) mounted on said reflector;

a bracket (4) mounted on said supports and having a socket recess (5), said socket recess having opposed walls;

terminals (6,7) provided in said socket recess on said opposed walls and electrically connected with said supports;

said pinch-sealed portion (12) of the halogen bulb being adjustably insertable in said socket recess (5) with said contact members (14,15) abuttingly contacting respective terminals (6,7);

said opposed walls having protrusions formed at respective positions opposite to and facing respective terminals to thereby provide a spacing between a portion of said opposed walls of said recess and a portion of said pinch-sealed portion of said bulb which is received in said recess; and means (16) for fixing said pinch-sealed portion in said recess.

2. The sealed beam lamp of claim 1, wherein said fixing means (16) comprises an adhesive in said spacing to fix said pinch-sealed portion in said recess.

3. The sealed beam lamp of claim 1, wherein said two terminals are disposed in respective ones of said opposed walls and comprising two protrusions, each of which is formed in a wall opposite a respective terminal.

4. The sealed beam lamp of claim 3, wherein the terminal portions of said lead-out contact members (14, 15) are disposed on opposing side surfaces of said pinch-sealed portion of said bulb so as to be in registration with and in electrical contact with said two terminals (6,7) in said recess when said pinch-sealed portion of said bulb is inserted in said recess.

5. The sealed beam lamp of claim 4, wherein said fixing means (16) comprises an adhesive in said spacing to fix said pinch-sealed portion in said recess.

* * * * *